US008794146B2

(12) United States Patent
Jo et al.

(10) Patent No.: US 8,794,146 B2
(45) Date of Patent: Aug. 5, 2014

(54) PRINTING DEVICE USING THERMAL ROLL IMPRINTING AND PATTERNED PLATE, MICROFLUODIC ELEMENT USING THE SAME, FILM LAMINATING DEVICE FOR SENSOR, AND PRINTING METHOD

(75) Inventors: Jeong-Dai Jo, Daejeon (KR); Jong-Su Yu, Daejeon (KR); Dong-Soo Kim, Daejeon (KR); Kwang-Young Kim, Daejeon (KR)

(73) Assignee: Korea Institute of Machinery & Materials, Daejeon (KR)

( * ) Notice: Subject to any disclaimer, the term of this patent is extended or adjusted under 35 U.S.C. 154(b) by 86 days.

(21) Appl. No.: 13/394,182

(22) PCT Filed: Sep. 7, 2010

(86) PCT No.: PCT/KR2010/006072

§ 371 (c)(1),
(2), (4) Date: Mar. 5, 2012

(87) PCT Pub. No.: WO2011/028080

PCT Pub. Date: Mar. 10, 2011

(65) Prior Publication Data

US 2012/0160115 A1 Jun. 28, 2012

(30) Foreign Application Priority Data

Sep. 7, 2009 (KR) ..... 10-2009-0084182

(51) Int. Cl.

| | |
|---|---|
| ***B41N 1/00*** | (2006.01) |
| ***B41M 1/24*** | (2006.01) |
| ***B41F 16/00*** | (2006.01) |

(52) U.S. Cl.
CPC ..... *B41F 16/00* (2013.01)
USPC ..... 101/401.1; 101/6

(58) Field of Classification Search
CPC ..... B41M 1/24; B41M 1/10; B41M 9/00
USPC ..... 101/401.1, 6, 12, 23, 32; 977/887
See application file for complete search history.

(56) References Cited

U.S. PATENT DOCUMENTS

| | | | | |
|---|---|---|---|---|
| 4,138,945 | A * | 2/1979 | Rejto | 101/470 |
| 4,898,752 | A * | 2/1990 | Cavagna et al. | 427/265 |

(Continued)

FOREIGN PATENT DOCUMENTS

| | | |
|---|---|---|
| CN | 1537054 | 10/2004 |
| CN | 1541852 | 11/2004 |
| CN | 101271269 | 9/2008 |
| KR | 10-2004-0093460 | 11/2004 |
| KR | 10-2007-0076292 | 7/2007 |
| KR | 10-0763493 | 10/2007 |
| KR | 10-0829198 | 5/2008 |
| KR | 10-2008-0085773 | 9/2008 |
| KR | 10-2009-0036728 | 4/2009 |
| KR | 10-2009-0089649 | 8/2009 |
| WO | 2004-021083 | 3/2004 |
| WO | 2008-102929 | 8/2008 |

*Primary Examiner* — Daniel J Colilla
*Assistant Examiner* — John M Royston
(74) *Attorney, Agent, or Firm* — Lexyoume IP Meister, PLLC

(57) ABSTRACT

A printing device using thermal roll imprinting and a patterned plate according to the present invention includes: a first supply roll continuously supplying a patterning film; a heating roll and a first sub-roll imprinting a first pattern in the patterning film supplied from the first supply roll by pressing the patterning film from both sides thereof to form a patterning plate; an imprinting mask provided with an original pattern to be imprinted to the patterning film and mounted on the surface of the heating roll; a first recovery roll recovering the patterned plate; a rotatable inking roll inking the first pattern imprinted to the patterned plate; a doctor blade forming a second; a blanket roll forming a third pattern; and a second sub-roll forming a fourth pattern by pressing a printing film and printing the third pattern of the blanket roll to the printing film.

9 Claims, 6 Drawing Sheets

(56) References Cited

U.S. PATENT DOCUMENTS

| | | | | |
|---|---|---|---|---|
| 5,772,905 | A | 6/1998 | Chou | |
| 5,992,320 | A * | 11/1999 | Kosaka et al. | 101/401.1 |
| 2006/0188598 | A1 | 8/2006 | Jeans | |
| 2007/0007883 | A1 * | 1/2007 | Takeda et al. | 313/503 |
| 2008/0017054 | A1 | 1/2008 | Sugiyama | |
| 2008/0122144 | A1 | 5/2008 | Zhang | |
| 2008/0229941 | A1 * | 9/2008 | Heidari | 101/23 |

* cited by examiner

PRINTING DEVICE USING THERMAL ROLL IMPRINTING AND PATTERNED PLATE, MICROFLUODIC ELEMENT USING THE SAME, FILM LAMINATING DEVICE FOR SENSOR, AND PRINTING METHOD

TECHNICAL FIELD

The present invention relates to a printing device using thermal roll imprinting and a patterned plate and a printing method using the same. More particularly, the present invention relates to a printing device using thermal roll imprinting and a patterned plate, which imprints a pattern in a patterning film and then performs final printing using the pattern of the patterned plate, and a printing method using the same.

The present invention relates to a microfluidic element and a film laminating device for a sensor. More particularly, the present invention relates to a microfluidic element and a film laminating device for a sensor that imprint a pattern to a micro-channel or plastic-based film for a sensor and then laminate a heterogeneous film to the film imprinted with the micro-channel or a sensor pattern.

BACKGROUND ART

For example, according to a known printing method, a plate or a roll where a pattern is formed is additionally formed and mounted on a printing device, and then the pattern on the plate or the roll is transferred to a paper by coating ink on the plate or the roll.

Since the printing device uses a thermal roll imprinting device, a pattern-engraved plate may be directly manufactured during a process, and a roll to roll printing device is mounted on a rear side of the printing device, and therefore gravure offset printing can be simultaneously performed, thereby manufacturing, for example, a plastic-based printed electron element.

However, it is difficult to form a less than 10 μm or several hundred manometer-scale pattern with an existing method such as mechanical processing and laser direct/indirect exposure. Thus, a printing device using an imprinting device or a roll to roll printing device cannot print a smaller than 10 μm or several hundred manometer-scale pattern and cannot manufacture a several hundred nanometer-scale electric and electron element.

In addition, when a plate or a roll used in a printing device is manufactured using a known method, manufacturing time and manufacturing cost are increased. Further, the plate and the roll have short life-span.

In case of manufacturing a pattern roll, a fine pattern is processed in a circular cylinder-shaped roll so that much more processes such as coating, machine and laser processing, etching, and the like are required, thereby deteriorating process accuracy.

When a printing process is iteratively performed using a plate or a pattern roll, ink remains in a fine pattern and a solvent is used to remove residual ink, thereby causing damage to the pattern.

DISCLOSURE

Technical Problem

The present invention has been made in an effort to provide a printing device using thermal roll imprinting and a patterned plate, which can be printed with a pattern smaller than 10 μm or several hundred nanometer-scale pattern, and a printing method using the same.

An exemplary embodiment of the present invention relates to a microfluidic element that can form a less than 10 μm or several hundred nanometer-scale pattern, and a film laminating device for a sensor.

Technical Solution

A printing device using thermal roll imprinting and a patterned plate according to an exemplary embodiment of the present invention includes: a first supply roll continuously supplying a patterning film; a heating roll and a first sub-roll imprinting a first pattern in the patterning film supplied from the first supply roll by pressing the patterning film from both sides thereof to form a patterning plate; an imprinting mask provided with an original pattern to be imprinted to the patterning film and mounted on the surface of the heating roll; a first recovery roll recovering the patterned plate; a rotatable inking roll inking the first pattern imprinted to the patterned plate; a doctor blade forming a second pattern by inking ink to a concave portion of the first pattern or removing residual ink in a convex portion in the patterned plate; a blanket roll forming a third pattern by pressing the patterned plated from the opposite side of the rotatable inking roll and receiving the ink from the patterned plate; and a second sub-roll forming a fourth pattern by pressing a printing film supplied from the opposite side of the blanket roll and printing the third pattern of the blanket roll to the printing film.

The printing device using the thermal roll imprinting and the patterned plate according to the exemplary embodiment of the present invention may further include a cooling device provided in a rear side of the heating roll and the first sub-roll along a transfer direction of the patterning film and the patterned plate to cool the patterned plate imprinted with the first pattern.

The printing device using the thermal roll imprinting and the patterned plate according to the exemplary embodiment of the present invention may further include a second supply roll provided in a rear side of the second sub-roll along a transfer direction of the printing film to supply the printing film and a second recovery roll provided in a front side of the second sub-roll to recover the printing film to which the pattern in transferred.

The printing device using the thermal roll imprinting and the patterned plate according to the exemplary embodiment of the present invention may further include a dry chamber disposed between the second sub-roll and the second recovery roll to dry and harden the printing film that forms the fourth pattern from transition of the third pattern.

The patterning film, the patterned plate, and the printing film may be formed of plastic-based films. The patterning film, the patterned plate, and the printing film may be formed of at least one of PC, PEN, and PET films.

A printing device using thermal roll imprinting and a patterned plate according to another exemplary embodiment of the present invention includes: a heating roll and a sub-roll forming a patterning plate by pressing a supplied patterning plate formed of a synthetic resin from both sides thereof and imprinting a first pattern to the patterning plate; an imprinting mask provided with an original pattern to be imprinted to the patterning plate and mounted on the surface of the heating roll; a dispenser inking the first pattern imprinted to the patterned plate; a doctor blade forming a second pattern by inking a concave portion of the first pattern with the ink from the patterned plate or removing residual ink of a convex portion of the patterned plate; a blanket roll pressing the patterned plate and receiving ink from the patterned plate to form a third pattern by; and a second sub-roll pressing a printing plate supplied from the opposite side of the blanket roll and printing the third plate of the blanket roll to the printing plate to form a fourth pattern.

A printing device using thermal roll imprinting and a patterned plate according to another exemplary embodiment of the present invention includes: a heating roll and a sub-roll forming a patterning plate by pressing a supplied patterning plate formed of a synthetic resin from both sides thereof and imprinting a first pattern to the patterning plate; an imprinting mask provided with an original pattern to be imprinted to the patterning plate and mounted on the surface of the heating roll; a rotatable inking roll mounting the patterned plate imprinted with the first pattern on the surface of the rotatable inking roll to ink the first pattern; a doctor blade forming a second pattern by inking a concave portion of the first pattern with the ink from the patterned plate or removing residual ink of a convex portion of the patterned plate; a blanket roll pressing the patterned plate from the opposite side of the rotatable inking roll and receiving ink from the patterned plate to form a third pattern; and a second sub-roll pressing a printing plate supplied from the opposite side of the blanket roll and printing the third plate of the blanket roll to the printing plate to form a fourth pattern.

A film laminating device for a microfluidic sensor according to another exemplary embodiment of the present invention includes: a supply roll continuously supplying a film for a micro-channel; a heating roll and a first sub-roll forming a film where a micro-channel is formed by pressing the film for the micro-channel supplied from the supply roll from both sides thereof and imprinting a micro-channel to the film for the micro-channel film; an imprinting mask provided with an original pattern to be imprinted to the film for the micro-channel and mounted on the surface of the heating roll; a laminating roll and a second sub-roll supplying a heterogeneous film to the micro-channel side of the film where the micro-channel is formed and pressing the film where the micro-channel is formed from one side and the heterogeneous film from the other side for lamination of the two films; and a recovery roll recovering the film where the micro-channel is formed and the heterogeneous film, which are laminated to each other.

The film laminating device for the microfluidic sensor according to the exemplary embodiment of the present invention may further include a cooling device provided in a rear side of the heating roll and the first sub-roll along a transfer direction of the film where the micro-channel is formed and cooling the film where the micro-channel is formed.

The film laminating device for the microfluidic sensor according to the exemplary embodiment of the present invention may further include a punching device provided in a rear side of the heating roll and the first sub-roll along a transfer direction of the film where the micro-channel is formed and punching the film where the micro-channel is formed.

A printing method according to an exemplary embodiment of the present invention includes: 1st step for manufacturing an imprinting mask having a fine original pattern; 2nd step for forming a patterned plate by forming a first pattern corresponding to the original pattern through thermal compression of a patterning film supplied to a thermal roll imprinting device mounted with the imprinting mask; 3rd step for inking the first pattern imprinted to the patterned plate using a roll to roll printing device; 4th step for forming a second pattern by inking a concave portion of the first pattern with ink in the patterned plate or removing residual ink of a convex portion of the patterned plate; 5th step for forming a third pattern in a blanket roll by pressing the blanket roll to the patterned plate and receiving ink of the second pattern from the patterned plate; and 6th step for forming a fourth pattern by pressing a printing film supplied to the blanket roll and printing the third pattern to the printing film.

The 1st step may manufacture the imprinting mask using electroforming.

The 2nd step may further include cooling of a plate where the first pattern is formed.

The 6th step may further include drying and hardening of the printing film formed a fourth pattern with transition of the third pattern.

<Description of Reference Numerals Indicating Primary Elements in the Drawings>

| | |
|---|---|
| 110: thermal roll implanting device | 111: cooling device |
| 113: punching device | 120: roll to roll printing device |
| 121: doctor blade | 220: roll to roll printing device |
| 222: dispenser | 130: thermal laminating device |
| 132: dry chamber | F1: patterning film |
| F2: printing film | PF41: film with micro-channel |
| F42: heterogeneous film | M: implanting mask |
| P1, P2, P3, P4: first, second, third, and fourth pattern | |
| PF1: patterned plate | |
| P41: micro-channel | PPL1, PL3: patterned plate |
| PL2: printing plate | R11: first supply roll |
| R12, R42: first and second recovery roll | R13, R43: support roll |
| R21: heating roll | R22: first sub-roll |
| R31: rotating inking roll | R32: blanket roll |
| R33, R52: second sub-roll | R41: second supply roll |
| R51: laminating roll | R53: supply roll |

Advantageous Effects

According to the exemplary embodiments of the present invention, a first pattern can be imprinted to a patterning film using an imprinting mask provided with an original pattern, a newly generated patterned plate can be printed using a roll to roll method, the first pattern can be imprinted to a patterning plate using the imprinting mask, and a newly generated patterned plate can be printed using a toll to plate or roll to roll method.

According to the exemplary embodiments of the present invention, the imprinting mask formed by electroforming and having flexibility is mounted on a heating roll so that the patterned plate can be formed by imprinting a less than 10 μm or several hundred nanometer-scale first pattern to a patterning film used in printing. That is, the imprinting mask enables imprinting of less than 10 μm or several hundred nanometer-scale pattern or elements to an imprinting target.

Further, according to the exemplary embodiments of the present invention, a micro-channel is imprinted to a film for a micro-channel using an imprinting mask manufactured by electroforming and a heterogeneous film is laminated to the film where the micro-channel is formed so that, e.g., a microfluid element having a nanometer-scale micro-channel and a film for a sensor can be laminated.

MODE FOR INVENTION

Figure 1:
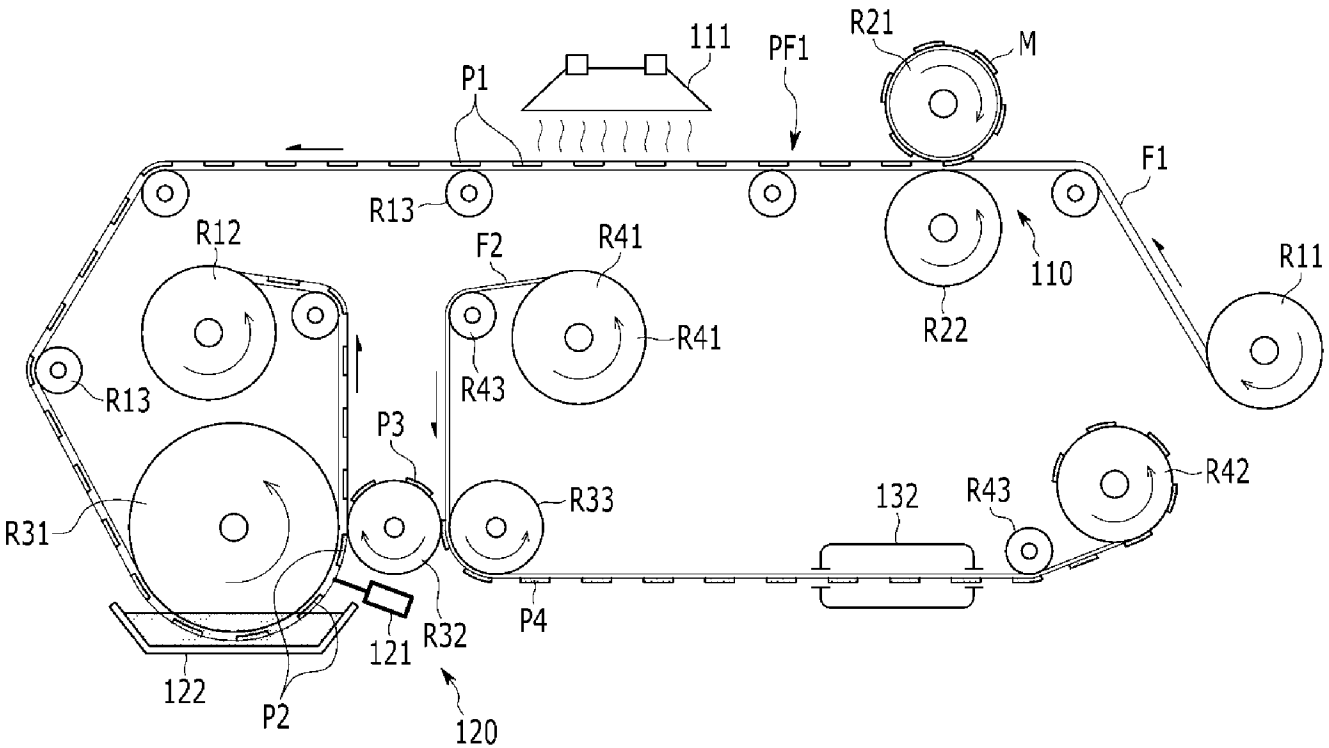
FIG. 1 is a schematic diagram of a printing device using thermal roll imprinting and a patterned plate according to a first exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

FIG. 1 is a schematic diagram of a printing device using thermal roll implanting and a patterned plate according to a first exemplary embodiment of the present invention. Referring to FIG. 1, a printing device using thermal roll imprinting and a patterned plate according to the first exemplary embodiment widely includes a thermal roll imprinting device 110 patterning, more particularly, imprinting a first pattern to a patterning film F1 and a roll to roll printing device 120 sequentially transferring the first pattern P1 of the patterned plate PF1 imprinted with the first pattern P1 to second and third patterns P2 and P3 by inking the first pattern P1 and finally forming a fourth pattern P4 in a printing film F2. Throughout the specification, the meaning of "patterned"includes the meaning of "imprinted".

The thermal roll imprinting device 110 includes a first supply roll R11 and a first recovery roll R12 transferring the patterned plate PF1 by supplying the patterning film F1 and recovering the patterned plate PF1, a heating roll R21 and a first sub-roll R22 that respectively support both sides of the patterning film F1 to imprint the first pattern P1 to the patterning film F1, and an imprinting mask M mounted on the heating roll R21.

While being rotatably driven, the first supply roll R11 and the first recovery roll R12 supply the patterning film F1 formed in the shape of a band, recover the patterned plate PF1, and provide a predetermined transfer speed with a tension set to the patterning film F1 and the patterned plate PF. At least one of support rolls R13 is provided between the first supply roll R11 and the first recovery roll R12 to support the patterning film F1 and the patterned plate PF1 or change a transfer direction of the patterned plate PF1.

The heating roll R21 and the first sub-roll R22 are rotatably driven to form the patterned plate PF1 by imprinting the first pattern P1 on the patterning film F1 using an original pattern formed in the imprinting mask M with application of a predetermined temperature and pressure to the patterning film F1 transferred between the heating roll R21 and the first sub-roll R22. The heating roll R21 applies heat to the patterning film F1 and the first sub-roll R22 presses the patterning film F1. Thus, the patterning film F1 is formed to a newly patterned plate PF1. The first pattern P1 formed in the patterned plate PF1 is formed in micrometer or nanometer scale according to the original pattern of the imprinting mask M.

The imprinting mask M has a fine pattern in micrometer or nanometer scale by electroforming As it is known, electroforming is a process for electro-depositing metal to a model sheet applied with a stripped sheet and separating the electrodeposited metal to acquire a protrusions and depressions product formed in the opposite shape of the surface of the model or processing sheet stripping on the surface of the electrodeposited metal and separating the metal by electrodeposition to acquire a protrusions and depressions product having the same shape of the original model. An electroforming-capable metal or alloy is a target of electroforming. The electroforming is effective in forming of a complicated or fine pattern. The imprinting mask M employed in the first exemplary embodiment may form the original pattern in micrometer or nanometer scale using the electroforming.

Since the heating roll R21 and the imprinting mask M are separately manufactured and mounted in a coupled manner, the original pattern can be formed in the imprinting mask M by electroforming. Further, the patterned plate PF1 is sequentially formed by sequentially formed a new first pattern P1 in the patterning film F1 using the imprinting mask M rather than inking the original pattern of the imprinting mask M, and the patterned plate PF1 is inked. Thus, the first pattern P1 formed in the patterned plate PF1 is transferred after being inked only one time, and therefore a cleansing process for cleansing the first pattern P1 used for the next transfer is eliminated.

Meanwhile, the thermal roll imprinting device 110 further includes a cooling device 111 cooling the patterned plate PF1 heated from imprinting of the first pattern P1 while passing between the rotatably driven heating roll R21 and first sub-roll R22.

The cooling device 111 is provided in a rear side of the heating roll R21 and the first sub-roll R22 along a transfer direction of the patterned plate PF1. Contraction and expansion of the patterned plate PF1 are minimized by cooling the heated patterned plate PF1 such that the shape of the first pattern P1 can be maintained.

The roll to roll printing device 120 is constructed to form a fourth pattern P4 in a printing film F2 by inking the first pattern P1 of the patterned plate PF1. The roll to roll printing device 120 includes a rotatable inking roll R31, a doctor blade 121, a blanket roll R32, and a second sub-roll R33.

The rotatable inking roll R31 is rotatably driven to make the patterned plate PF1 pass through ink so as to ink the first pattern P1 imprinted in the patterned plate PF1 by winding the patterned plate PF1, and provided in front of the first recovery roll R12

In addition, the rotatable inking roll R31 is partially soaked in an ink container 122 to make the patterned plate PF1 pass through the ink container 122 containing the ink. Thus, the patterned plate PF1 inks the first pattern P1 as the first supply roll R11, the first recovery roll R12, and the rotatably inking roll are rotatably driven.

The doctor blade 121 inks a concave portion of the first pattern P1 with the ink of the pattern plate PF1 or removes residual ink in a convex portion of the patterned plate PF1 such that a second pattern P2 is formed. That is, the doctor blade 121 is provided corresponding to the width of the patterned plate PF1 and the width of the rotatable inking roll R31 to press at least the patterned plate PF1 from the opposite side of the rotatable inking roll R31.

The blanket roll R32 is rotatably driven and presses the patterned plate PF1 from the opposite side of the rotatable inking roll R31 such that the both sides of the patterned plate PF1 of which the first pattern P1 is inked are respectively pressed by the blanket roll R32 and the rotatable inking roll R31 and accordingly ink of the second pattern P2 is transferred from the patterned plate PF1. That is, the third pattern P3 is formed in the blanket roll R32.

For convenience, patterns transferred from the original pattern of the imprinting mask M are sequentially denoted as the first, second, third, and fourth patterns P1, P2, P3, and P4 according to a transfer sequence. The patterned plate PF1 transferred the ink of the first pattern P1 to the second pattern P2 is transferred and recovered by being wound around the first recovery roll R12.

A second sub-roll R33 is rotatably driven and presses the band-shaped printing film F2 supplied from the opposite side of the blanket roll R32. That is, the second sub-roll R33 presses the printing film F2, together with the blanket roll R32 to print the third pattern P3 of the blanket roll R32 to the printing film F2. Here, the printing film F2 is separated from the patterned plate PF1 and additionally supplied. That is, the fourth pattern P4 is formed in the printing film F2.

The roll to roll printing device 120 may further include a second supply roll R41 and a second recovery roll R42 that transfer the printing film F2. The second supply roll R41 and the second recovery roll R42 are rotatably driven and provide a predetermined transfer speed with a tension set to the printing film F2 while supplying the band-shaped printing film F2. At least one of support rolls R43 is provided between the second supply roll R41 and the second recovery roll R42 to support the printing film F2 or change a transfer direction of the printing film F2.

For this purpose, the second supply roll R41 is disposed in a rear side of the second sub-roll R33 to supply the printing film F2 along a transfer direction of the printing film F2, and the second recovery roll R42 is disposed in a front side of the second sub-roll R33 to recover the printing film F2 along a transfer direction of the printing film F2.

Meanwhile, the roll to roll printing device 120 further includes a dry chamber 132 for drying and hardening the printing film F2 that passes between the blanket roll R32 and the second sub-roll R33 and the fourth pattern P4 transferred to the printing film F2. The dry chamber 132 is disposed between the second sub-roll R33 and the second recovery roll R42 along a transfer direction of the printing film F2. That is, the printing film F2 to which the fourth pattern P4 is printed is dried and hardened.

The original pattern of the imprinting mask M is imprinted as the first pattern P1 to the patterning film F1 to form the patterned plate PF1 and then printed as the fourth pattern P4 in the printing film F2 via the second pattern P2 through the patterned plate PF1, the rotatable inking roll R31, and the blanket roll R32 and the third pattern P3 of the second sub-roll R33.

The patterning film F1, the patterned plate PF1, and the printing film F2 may be formed of plastic-based films. For example, the patterning film F1, the patterned plate PF1, and the printing film F2 may be formed of polycarbonate (PC), PEN( ) or polyethylenenaphthalate (PEN), or polyethyleneterephthalate (PET) to imprint the first pattern P1 from the original pattern of the imprinting mask M by heating the heating roll R21 and pressing the first sub-roll R22.

Compared to manufacturing time and manufacturing cost of a conventional pattern roll or plate, manufacturing time and manufacturing cost of the patterned plate PF1 can be decreased. Since a new patterned plate PF1 is continuously formed, the patterned plate PF1 does not decrease of lifespan. The imprinting mask M uses a semi-persistent electroforming mask, and therefore a plastic plate having a fine pattern can be mass-produced.

The patterned plate PF1 is flexible, and therefore it can be applied to the roll to roll printing device 120 (refer to FIG. 1) or the roll to printing device 220 (refer to FIG. 2) in various manner. The patterning film F1 continuously forms the patterned plate PF1 newly imprinted with the first pattern P1, and the patterned plate PF1 is recovered after each pattern thereof printed one time and accordingly the cleaned first pattern P1 can be continuously provided. That is, the cleansing process is eliminated and damage to the pattern due to cleansing solvent can be prevented.

The printing device according to the first exemplary embodiment can be variously applied such as micro-electromechanical systems (MEMS), nano-electromechanical systems (NEMS), bio chips, and medical sensors. Hereinafter, various exemplary embodiments of the present invention will be described, and a description of a portion equivalent to the first exemplary embodiment will be omitted.

Figure 2:
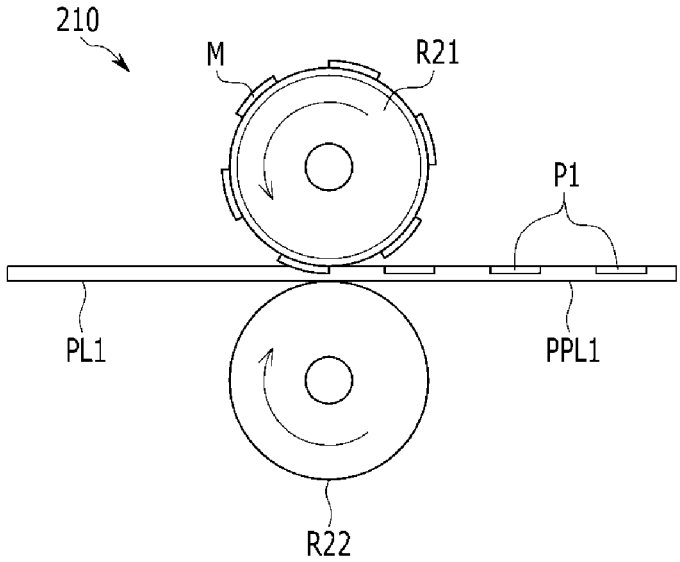
FIG. 2 is a schematic diagram of a thermal roll implanting device imprinting a first pattern to a patterning plate in a printing device using thermal roll implanting and a patterned plate according to a second exemplary embodiment of the present invention.
Figure 3:
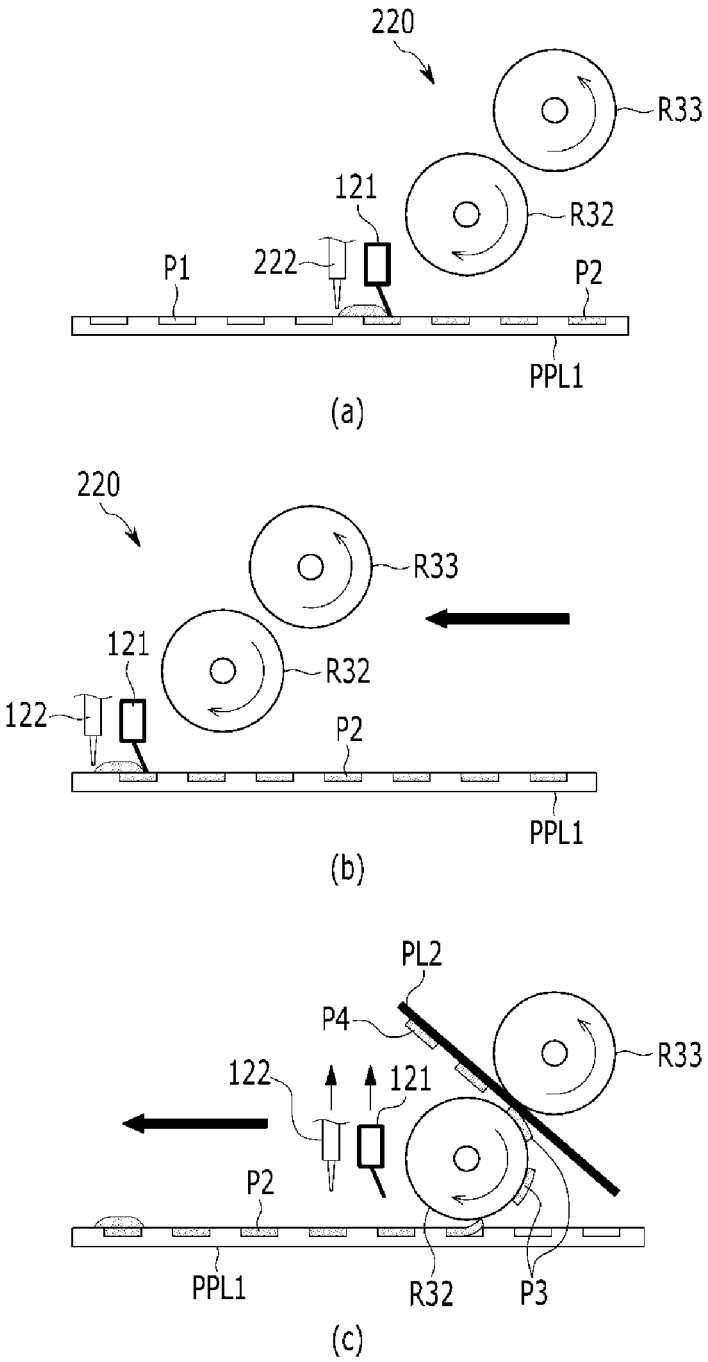
FIG. 3 is a configuration diagram of a roll to roll printing device using a plate for printing and a printing process view of the printing device using the thermal roll imprinting and the patterned plate.

FIG. 2 is a schematic diagram of a thermal roll implanting device imprinting a first pattern to a patterning plate in a printing device using thermal roll implanting and a patterned plate according to a second exemplary embodiment of the present invention, and FIG. 3 is a configuration diagram of a roll to roll printing device using a plate for printing and a printing process view of the printing device using the thermal roll imprinting and the patterned plate.

In the first exemplary embodiment, the original pattern of the imprinting mask M is imprinted to the patterning film F1 and a pattern is printed to the printing film F2 using the patterned plate PF1 through the roll to roll printing method.

However, in the second exemplary embodiment, a patterned plate PP11 is formed by imprinting an original pattern of an imprinting mask M to a patterning plate PL1 (refer to FIG. 2), and a pattern is printed to a printing plate PL2 using the patterned plate PPL1 through a roll to roll printing method (refer to FIG. 3). That is, the roll to roll printing device 120 in the first exemplary embodiment may be replaced a roll to plate printing device 220 in the second exemplary embodiment.

Referring to FIG. 2, in a thermal roll imprinting device 210, a heating roll R21 and a first sub-roll R22 press a supplied patterning plate PL1 made of a synthetic resin from both sides thereof to imprint the first pattern P1 such that a patterned plate PPL1 is formed. That is, the patterned plate PPL1 where the first pattern P1 is formed is formed. Since the line width of the first pattern P1 is 10 μm and the height thereof is several nanometers, the first pattern P1 can be variously applied as a printed electronics element.

The roll to roll printing device 120 of the first exemplary embodiment uses the ink container 122, but the roll to plate printing device 220 of the second exemplary embodiment uses a dispenser 222. Referring to FIG. 3, the roll to plate printing device 220 is provided with the dispenser 222 that inks the first pattern imprinted to the patterned plate PPL1. The dispenser 222 supplies ink to the patterned plate PPL1 (refer to (a) of FIG. 3).

A doctor blade 121 inks a concave portion of the first pattern p1 in the patterned plate PPL1 or removes residual ink in a convex portion of the first pattern P1 to form a second pattern P2 (refer to (b) of FIG. 3). A blanket roll R32 receives ink from the patterned plate PPL1 by pressing the patterned plate PPL1 to form a third pattern P3. Subsequently, a second sub-roll R33 prints the third pattern P3 of the blanket roll R32 to a printing plate PL2 by pressing a printing plate PL2 supplied from the opposite side of the blanket roll R32 to form a fourth pattern P4 (refer to (c) of FIG. 3).

Figure 4:
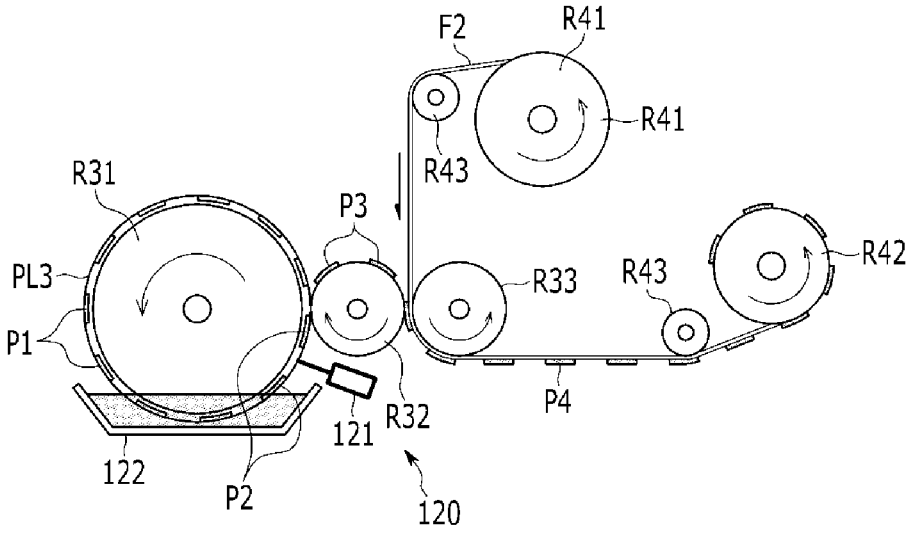
FIG. 4 is a schematic diagram of a roll to roll printing device that uses a patterned plate for printing in a printing device using thermal roll imprinting and a patterned plate according to a third exemplary embodiment of the present invention.

FIG. 4 is a schematic diagram of a roll to roll printing device performing printing using a patterned plate in a printing device using thermal roll imprinting and a patterned plate according to a third exemplary embodiment of the present invention.

As in the second exemplary embodiment, in the third exemplary embodiment, a plate PL3 patterned by imprinting a first pattern P1 in a patterning plate PL1 is formed using a thermal roll imprinting device 210, and the patterned plate PL3 is applied to the roll to printing device 120 of the first exemplary embodiment using flexibility of the patterned plate PL3.

The patterned plate PL3 manufactured in the thermal roll imprinting device 210 is mounted on the surface of a rotatable inking roll R31. The rotatable inking roll R31 is rotatably driven to ink in an ink container 122 to the first pattern P1 of the patterned plate PL3.

Figure 5:
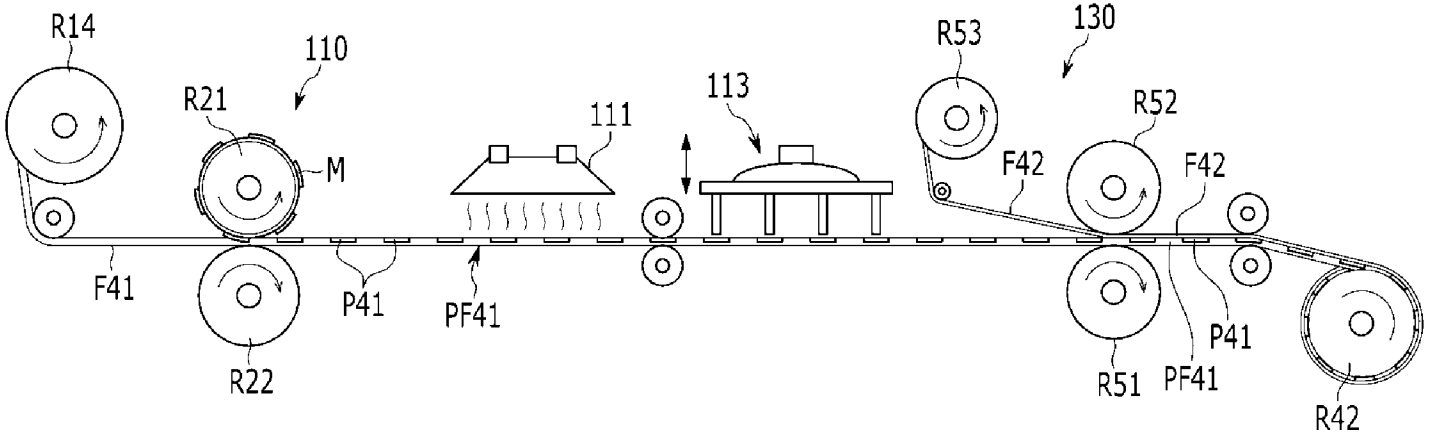
FIG. 5 is a schematic diagram of a forth exemplary embodiment in which a micro-channel channel is formed in a film for a micro-channel using the thermal roll imprinting device of first to third exemplary embodiments and then a coating film is laminated to the film where the micro-channel is formed.

FIG. 5 is a schematic diagram of a fourth exemplary embodiment forming a micro-channel in a film for a micro-channel using the thermal roll imprinting device of the first to third exemplary embodiments and then laminating a heterogeneous film in the film where the micro-channel is formed. The fourth exemplary embodiment is the same as the first to third exemplary embodiments in using the thermal roll imprinting device 110 commonly applied to the first to third exemplary embodiments.

In comparison between the first exemplary embodiment and the fourth exemplary embodiment, the first exemplary embodiment transfers the patterning film F1 and the patterned plate PF1 with the first supply roll R11 and the first recovery roll R12. However, in the fourth exemplary embodiment, a micro-channel film F41 and a film PF4 where a micro-channel is formed are transferred to a supply roll R41 and a recovery roll R42, and the recovery roll R42 recovers the film where the laminated micro-channel is formed and the heterogeneous film F42. The heterogeneous film F42 is supplied from an additional supply roll R53.

In the first exemplary embodiment, the patterned plate PF1 is formed by imprinting the first pattern P1 to the patterning film F1 with the heating roll R21 and the first sub-roll R22. However, in the fourth exemplary embodiment, the heating roll R21 and the first sub-roll R22 imprint a pattern, that is, a micro-channel P41 to the film F41 for the micro-channel to form a film PF41 where a micro-channel is formed.

In the first exemplary embodiment, the fourth pattern P4 is printed to the printing film F2 using the roll to roll printing device 120. However, in the fourth exemplary embodiment, the heterogeneous film F42 is laminated to the film PF41 where the micro-channel is formed using a thermal laminating device 130.

That is, a laminating roll R51 and a second sub-roll R52 supply the heterogeneous film F42 to the micro-channel P41 side of the film PF41 where the micro-channel is formed, and the second sub-roll R52 presses the film PF41 where the micro-channel is formed and the laminating roll R51 presses the heterogeneous film F42 such that the two films are laminated to each other.

A cooling device 111 is provided in a rear side of the heating roll R21 and the first sub-roll R22 along a transfer direction of the film F41 for the micro-channel and the film PF41 where the micro-channel is formed to cool the film PF41 where the micro-channel is formed such that contraction and expansion of the film PF41 where the micro-channel is formed can be minimized and thus the micro-channel P41 can maintain its shape.

A punching device 113 is provided in a rear side of the heating roll R21 and the first sub-roll R22 along a transfer direction of the film PF41 where the micro-channel is formed to punch the film PF41 where the micro-channel is formed and the pattern is imprinted. Further, the punching device 113 may be provided in a rear side of the cooling device 111 to punch a film PF41 where the cooled micro-channel is formed.

While the film PF41 where the micro-channel is formed and the heterogeneous film F42 are being laminated, the micro-channel P41 forms a micro-channel P41 through which fluid flows or charged with fluid. In this case, the punching device 113 forms an injection opening in the film PF41 where the micro-channel is formed for injection of the fluid into the micro-channel P41.

The thermal roll imprinting device 110 and the thermal laminating device 130 simplify construction of the micro-channel fluid channel without using conventional hot embossing or photolithography process.

The heating roll R21 enables mounting and dismounting of the imprinting mask M, several or several types of patterns, that is, micro-channels P41 can be simultaneously formed depending on the size of the diameter of the heating roll R21.

Since the thermal roll imprinting device 110 and the thermal laminating device 130 are sequentially provided, imprinting of the pattern, that is, the micro-channel P41 to the film F41 for the micro-channel and laminating of the heterogeneous film F42 can be sequentially performed, thereby completing the micro-channel P41 through the consecutive process.

Figure 6:
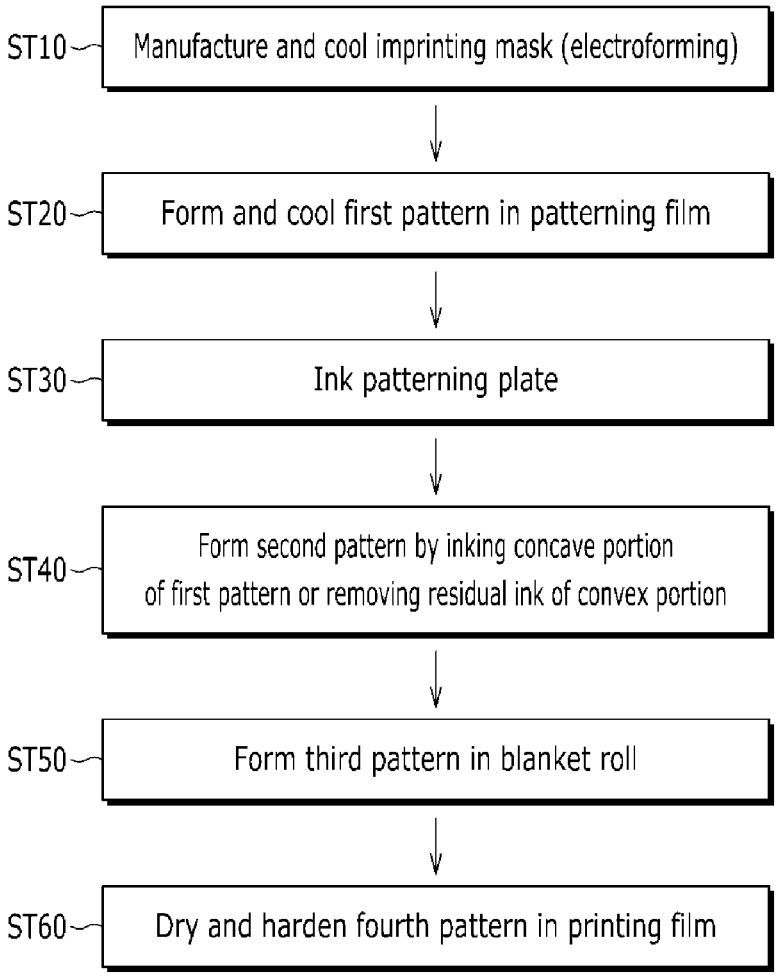
FIG. 6 is a flowchart of a printing method using a printing device employing the thermal roll imprinting and the patterned plate according to the exemplary embodiments of the present invention.

FIG. 6 is a flowchart of a printing method using the thermal roll imprinting and the patterned plate according to the exemplary embodiments of the present invention. For convenience, a printing method of the printing device of the first exemplary embodiment will be exemplarily described. The printing method has been broadly described in description of the printing device, but the printing method will now be briefly described again.

The printing method using the printing device includes 1st step for manufacturing an imprinting mask M having an original pattern (ST10), 2nd step for forming a first pattern P1 corresponding to the original pattern (ST20), 3rd step for inking a patterned plate PF1 where the first pattern P1 is formed (ST30), 4th step for forming a second pattern P2 by inking the first pattern P1 (ST40), 5th step for forming a third pattern P3 through transition of the ink in the second pattern P2 (ST50), and 6th step for forming a fourth pattern P4 through transition of ink in the third pattern P3.

In the 1st step (ST10), the imprinting mask M is formed by forming a fine original pattern in a flexible metal or a metal-alloy plate through electroforming.

In the 2nd step (ST20), the patterned plate PF1 is formed by imprinting the first pattern P1 with thermal compression of a patterning film F1 supplied to a roll imprinting device 110. In the 2nd step (ST20), the patterned plate PF1 imprinted with the first pattern P1 is cooled to maintain the shape of the first pattern P1.

In 3rd step (ST30), the first pattern P1 imprinted to the patterned plate PF1 is inked using a roll to roll printing device 120.

In the 4th step (ST40, the ink in the patterned plate PF1 is applied to a concave portion of the first pattern P1 or residual ink in a convex portion of the patterned plate PF1 is removed using a doctor blade 121 to thereby form a second pattern P2.

In the 5th step (ST50), the patterned plate PF1 is pressed by a blanket roll R22 to receive ink of the second pattern P2 from the patterned plate to form a third pattern P3 in the blanket roll R32.

In the 6th step (ST60), a printing film F2 supplied to the blanket roll R2 is pressed using a second sub-roll R33 to print the third pattern P3 to the printing film F2 such that a fourth pattern P4 is formed. In the 6th step (ST60), a fourth pattern P4 formed from transition of the ink of the third pattern P3 is dried and hardened.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. A printing device using thermal roll imprinting and a patterned plate, comprising:

a first supply roll continuously supplying a patterning film;

a heating roll and a first sub-roll imprinting a first pattern in the patterning film supplied from the first supply roll by pressing the patterning film from both sides thereof to form a patterning plate;

an imprinting mask provided with an original pattern to be imprinted to the patterning film and mounted on the surface of the heating roll;

a cooling device provided downstream of the heating roll and the first sub-roll along a transfer direction of the patterned plate to cool the patterned plate imprinted with the first pattern;

a rotatable inking roll inking the first pattern imprinted to the patterned plate by winding the patterned plate;

a doctor blade forming a second pattern by inking ink to a concave portion of the first pattern or removing residual ink in a convex portion in the patterned plate;

a first recovery roll provided downstream of the rotatable inking roll along a transfer direction of the patterned plate to recover the patterned plate;

a blanket roll forming a third pattern on the blanket roll by pressing the patterned plate from both sides thereof together with the rotatable inking roll and receiving the ink from the patterned plate; and a second sub-roll forming a fourth pattern by pressing a printing film from both sides thereof together with the blanket roll and printing the third pattern of the blanket roll to the printing film.

2. The printing device using the thermal roll imprinting and the patterned plate of claim 1, further comprising:

a second supply roll provided upstream of the second sub-roll along a transfer direction of the printing film to supply the printing film; and a second recovery roll provided downstream of the second sub-roll along a transfer direction of the printing film to recover the printing film to which the pattern is transferred.

3. The printing device using the thermal roll imprinting and the patterned plate of claim 2, further comprising a dry chamber disposed between the second sub-roll and the second recovery roll to dry and harden the printing film where the fourth pattern from transition of the third pattern is formed.

4. The printing device using the thermal roll imprinting and the patterned plate of claim 1, wherein the patterning film, the patterned plate, and the printing film are formed of plastic-based films.

5. The printing device using the thermal roll imprinting and the patterned plate of claim 4, wherein the patterning film, the patterned plate, and the printing film are formed of at least one of PC, PEN, and PET films.

6. A printing device using thermal roll imprinting and a patterned plate, comprising:

a heating roll and a sub-roll forming a patterning plate by pressing a supplied patterning plate formed of a synthetic resin from both sides thereof and imprinting a first pattern to the patterning plate;

an imprinting mask provided with an original pattern to be imprinted to the patterning plate and mounted on the surface of the heating roll;

a cooling device provided downstream of the heating roll and the sub-roll along a transfer direction of the patterned plate to cool the patterned plate imprinted with the first pattern;

a dispenser inking the first pattern imprinted to the patterned plate;

a doctor blade forming a second pattern by inking a concave portion of the first pattern with the ink from the patterned plate or removing residual ink of a convex portion of the patterned plate;

a blanket roll pressing the patterned plate and receiving ink from the patterned plate to form a third pattern by; and a second sub-roll pressing a printing plate from both sides thereof together with the blanket roll and printing the third pattern of the blanket roll to the printing plate to form a fourth pattern.

7. A printing device using thermal roll imprinting and a patterned plate, comprising:

a heating roll and a sub-roll forming a patterning plate by pressing a supplied patterning plate formed of a synthetic resin from both sides thereof and imprinting a first pattern to the patterning plate;

an imprinting mask provided with an original pattern to be imprinted to the patterning plate and mounted on the surface of the heating roll;

a cooling device provided downstream of the heating roll and the sub-roll along a transfer direction of the patterned plate to cool the patterned plate imprinted with the first pattern;

a rotatable inking roll mounting the patterned plate imprinted with the first pattern on the surface of the rotatable inking roll to ink the first pattern;

a doctor blade forming a second pattern by inking a concave portion of the first pattern with the ink from the patterned plate or removing residual ink of a convex portion of the patterned plate;

a blanket roll pressing the patterned plate from both sides thereof together with the rotatable inking roll and receiving ink from the patterned plate to form a third pattern; and a second sub-roll pressing a printing plate from both sides thereof together with the blanket roll and printing the third pattern of the blanket roll to the printing plate to form a fourth pattern.

8. A printing method comprising:

1st step for manufacturing an imprinting mask having a fine original pattern by using electroforming;

2nd step for forming a patterned plate by forming a first pattern corresponding to the original pattern through thermal compression of a patterning film supplied to a thermal roll imprinting device mounted with the imprinting mask and cooling of the patterned plate where the first pattern is formed;

3rd step for inking the first pattern imprinted to the patterned plate using a roll to roll printing device;

4th step for forming a second pattern by inking a concave portion of the first pattern with ink in the patterned plate or removing residual ink of a convex portion of the patterned plate;

5th step for forming a third pattern in a blanket roll by pressing the blanket roll to the patterned plate and receiving ink of the second pattern from the patterned plate; and 6th step for forming a fourth pattern by pressing a printing film supplied to the blanket roll and printing the third pattern to the printing film.

9. The printing method of claim 8, wherein the 6th step further comprises drying and hardening of the printing film where a fourth pattern from transition of the third pattern is formed.

* * * * *